US006491503B2

(12) United States Patent
Hoffmann

(10) Patent No.: US 6,491,503 B2
(45) Date of Patent: Dec. 10, 2002

(54) DELIVERY DEVICE

(75) Inventor: Heinrich Hoffmann, Heringen (DE)

(73) Assignee: Mannesmann VDO AG, Frankfurt am Main (DE)

( * ) Notice: Subject to any disclaimer, the term of this patent is extended or adjusted under 35 U.S.C. 154(b) by 14 days.

(21) Appl. No.: 09/894,445

(22) Filed: Jun. 28, 2001

(65) Prior Publication Data

US 2002/0009375 A1 Jan. 24, 2002

(30) Foreign Application Priority Data

Jul. 7, 2000 (DE) ..... 100 33 288

(51) Int. Cl.[7] ..... F04B 17/00; F04B 35/00
(52) U.S. Cl. ..... 417/360; 239/284.1
(58) Field of Search ..... 417/360, 366, 417/442, 423.14; 239/284.1, 284.2; 415/152.1; 15/250.02

(56) References Cited

U.S. PATENT DOCUMENTS

| | | | | |
|---|---|---|---|---|
| 3,909,872 A | * | 10/1975 | Molenaar | 15/250.02 |
| 4,919,591 A | * | 4/1990 | Kamimura et al. | 415/152.1 |
| 5,344,293 A | * | 9/1994 | Mota et al. | 417/442 |
| 5,480,289 A | * | 1/1996 | Lee | 417/360 |
| 5,865,376 A | * | 2/1999 | Krizek et al. | 239/284.1 |
| 6,015,276 A | * | 1/2000 | Ponzioni | 417/423.14 |
| 6,254,360 B1 | * | 7/2001 | Sato | 417/366 |
| 6,402,052 B1 | * | 6/2002 | Murawa | 239/284.1 |
| 2002/0005440 A1 | * | 1/2002 | Holt et al. | 239/284.2 |

* cited by examiner

*Primary Examiner*—Teresa Walberg
*Assistant Examiner*—Leonid M Fastovsky
(74) *Attorney, Agent, or Firm*—Richard A. Speer; Mayer, Brown, Rowe & Maw

(57) ABSTRACT

A delivery device having a retaining mechanism for pre-tensioning a valve against a feed pump that is installed in an area removed from the sealing structure that provides surfaces used to seal the connection between the valve and the feed pump. The retaining mechanism has a locking device.

8 Claims, 3 Drawing Sheets

DELIVERY DEVICE

BACKGROUND OF THE INVENTION

The subject of this invention is a delivery device for the delivery of fluid into two mutually independent nozzles using a feed pump, and having a valve connecting the feed pump optionally with a first or a second nozzle, and having sealing devices and retaining mechanisms for a sealed connection between the valve and the feed pump.

Delivery devices of this type, for example, are often used to deliver washing fluid in windshield washer systems for motor vehicles, and their practical applications are well known. The feed pump of the known delivery device can be driven in its two rotational directions, and has one intake and two outlets. Depending on the rotational direction of the feed pump, at one of the outlets overpressure is being generated while at the other one underpressure is being generated. This overpressure and underpressure moves a membrane in the valve, so that the outlet with the overpressure is connected to the designated nozzle. For their connection, the feed pump and the valve are equipped with side by side pairs of interlocking nozzles with an O-Ring forced in between each. The O-rings seal the nozzles against each other, and fasten the valve to the feed pump.

The disadvantage of the known device is its use of O-rings, which are very expensive and difficult to install. The high number of O-rings required for just one delivery device makes its manufacture very expensive.

BRIEF SUMMARY OF THE INVENTION

The objective of this invention is to improve a delivery device of the aforementioned type to such extent that its manufacture becomes very economical.

The invention solves the problem by placing the sealing devices and the retaining mechanisms apart from each other.

This design avoids the joint placement of the sealing devices and the retaining mechanisms in the area where the feed pump connects to the valve. This allows for an especially simple design for the sealing devices and retaining mechanisms without the use of expensive O-rings and makes the delivery device introduced by this invention especially economical.

In an advanced design, the retaining mechanisms are especially simple when a locking device is employed.

In another advanced design, the sealing devices can be easily designed for a specific sealing pressure if the retaining mechanisms are designed to provide the initial tension for the sealing devices.

An additional advanced design of the invention using a small number of retaining mechanisms provides a simple solution to prevent the valve from tilting relative to the feed pump by locating the retaining mechanisms between two pairs of interconnected nozzles of the feed pump and valve. In the simplest case, the design of the delivery device described in this invention requires only one retaining mechanism.

Proper sealing between valve and feed pump is reliably guaranteed as the result of a further advanced design, if the nozzles of the feed pump and the valve are designed to interlock conically.

With the valve pre-lightened relative to the feed pump, the seal (even in the presence of high pressures) is especially reliable, if at least one of the nozzles has circumferentially extending sealing beads. Along the sealing beads, the nozzles exhibit especially high surface pressure.

In a further advanced design, the locking device can be designed especially easily, if the locking device is comprised of interlocking latching hooks.

In another design step, the valve is reliably connected to the feed pump, if the locking device extends nearly across the entire area between the nozzles.

In another advanced design, the nozzles of the feedpump have two areas each designed as fixed fitting and as sealing fitting.

It has been proven to be especially advantageous for the sealing fitting to be installed at the end of the pump nozzle while the fixed fitting is located closer to the feed pump. Both surfaces can be designed as beads, which fit into matching recesses in the valve nozzles.

BRIEF DESCRIPTION OF THE DRAWINGS

The invention allows numerous designs. In order to illustrate the basic concept, several of those designs are shown in the figures and will be described below.

DETAILED DESCRIPTION OF THE EMBODIMENT

Figure 1:
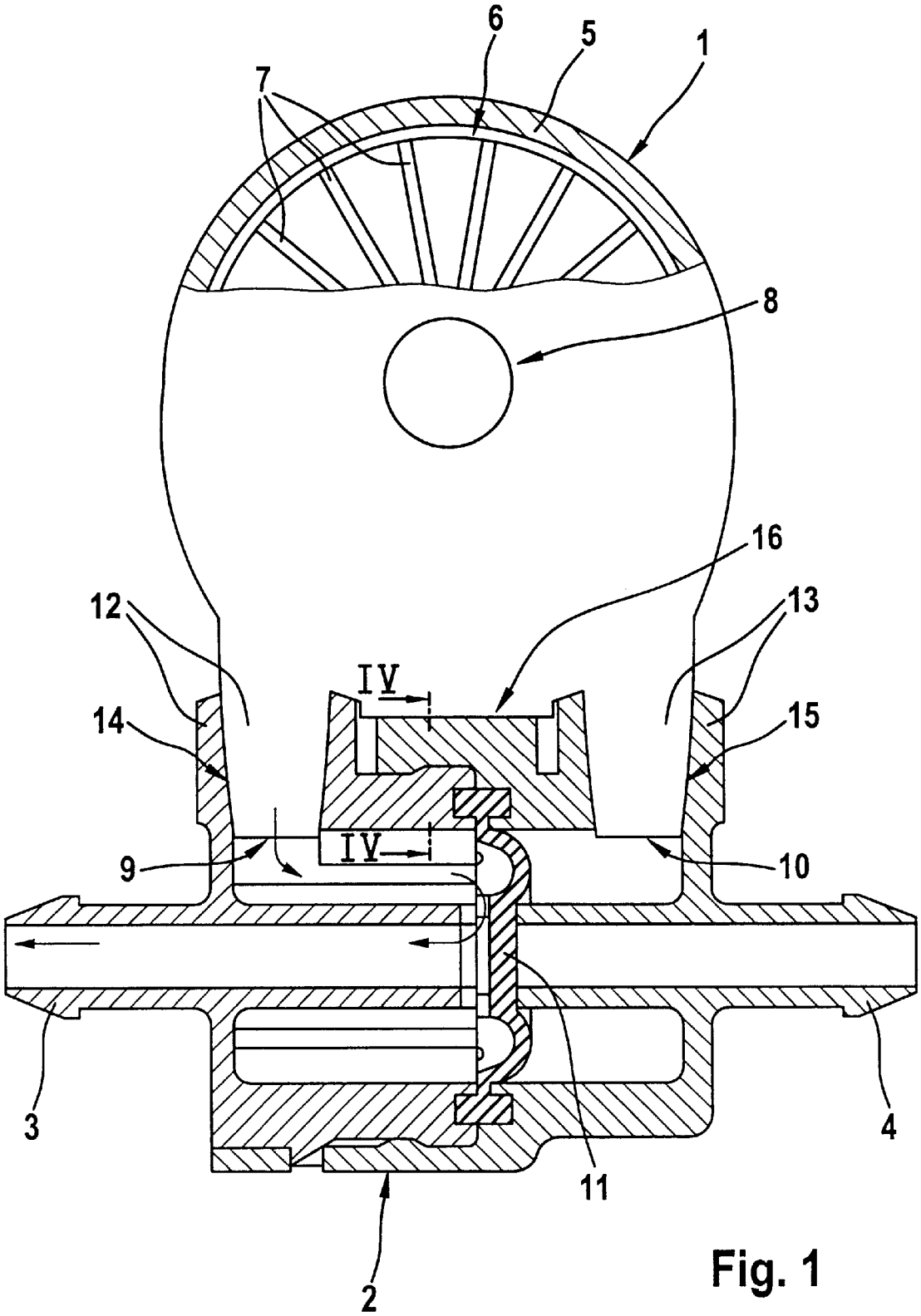
FIG. 1 is a partial sectional view of the delivery device of this invention.

FIG. 1 shows a delivery device with a feed pump 1, with a valve 2 and with two nozzles 3,4. For clarification, the valve 2 is shown in sectional view and the feed pump in a partial sectional view. The feed pump 1 has a runner 6 with guide blades 7 rotating in a pump housing 5. Towards the center of the runner 6, the pump housing 5 has an intake 8 and on the side facing valve 2 two outlets 9, 10.

Depending on the rotational direction of the runner 6, an overpressure will be generated at either one of the outlets 9, 10. The valve 2 has a moving membrane 11 connecting the outlet with overpressure 9 or 10 to one of the outlet nozzles 3, 4. For clarification purposes, the flow of the fluid to be delivered by the feed pump 1 and the valve 2 for one rotational direction of the runner 6 has been indicated by arrows in the figure. The feed pump 1 and the valve 2 have two pairs of interlocking nozzles 12,13. The nozzles 12, 13 have cooperating sealing surfaces 14, 15 which are shaped to seal the feed pump 1 against the valve 2. Between the two pairs of nozzles 12, 13, the delivery device has a retaining mechanism 16 for pretensioning the feed pump 1 against the valve 2. The figure shows that the retaining mechanisms 16 extend across the entire area between the nozzles 12, 13.

Figure 2:
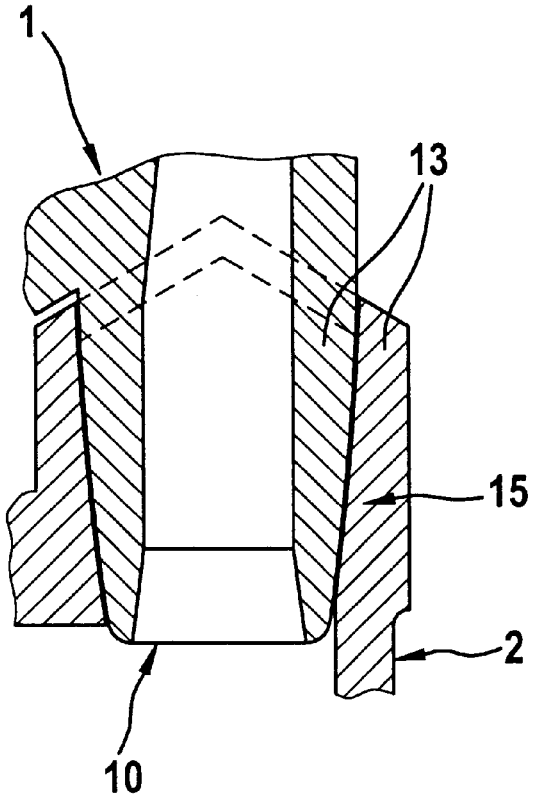
FIG. 2 is an enlarged view of the sealing structure for the delivery device shown in FIG. 1.

FIG. 2 shows the strongly enlarged sealing structure 15 of a pair of interlocking nozzles 13 from FIG. 1. As can be seen, each of the nozzles 13 is cone-shaped. The pretension provided by the retaining mechanisms 16 from FIG. 1 causes the nozzles 13 to be pre-tightened against each other and to seal the connection between the feed pump 1 and the valve 2.

Figure 3:
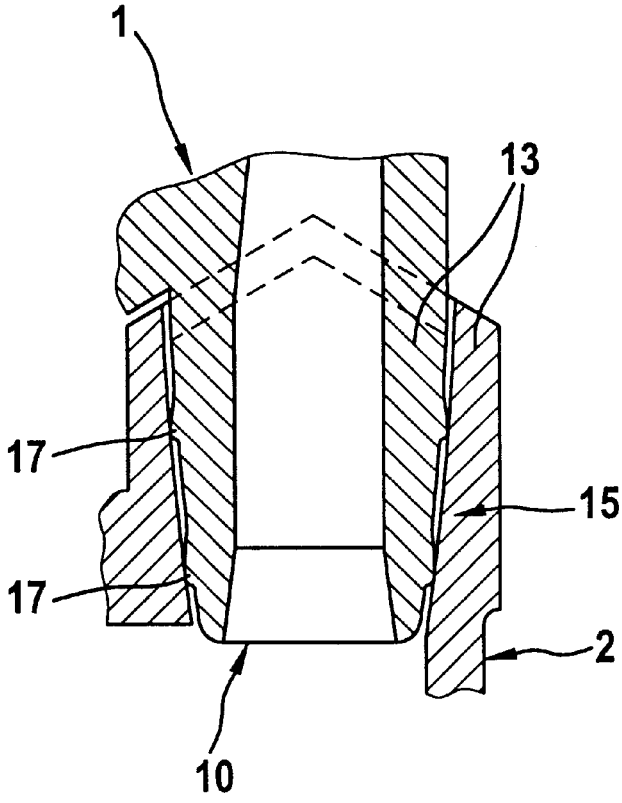
FIG. 3 is a modified design of a sealing structure for use in the delivery device of FIG. 1.

FIG. 3 shows a strongly enlarged design of the sealing devices 15 in one of the pairs of interlocking nozzles 13 from FIG. 1. The illustration indicates that nozzles 13 of the feed pump 1 have a total of two circumferential or annular sealing beads 17. In the area between the sealing beads 17, the nozzles 13 are relieved so that beads 17 are spaced from each other. As in the design shown in FIG. 2. the nozzles 13 are pre-tightened against each other by the retaining mechanisms 16 from FIG. 1.

Figure 4:
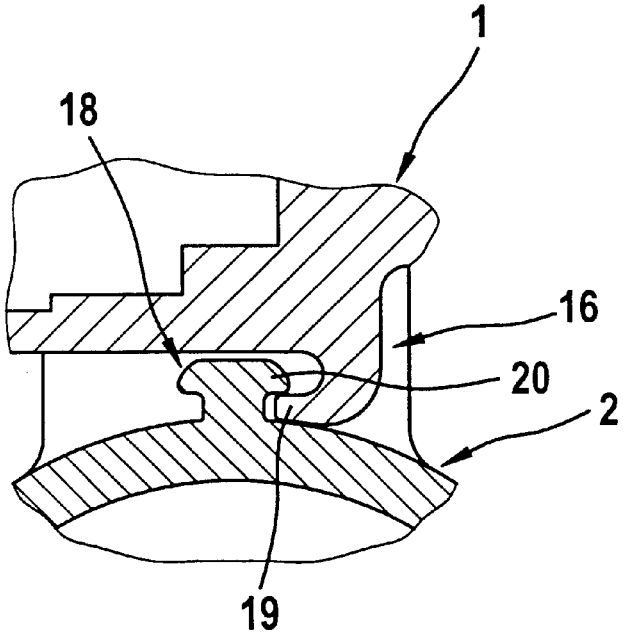
FIG. 4 is an enlarged sectional view of the retaining mechanisms of the delivery device taken along the IV—IV line of FIG. 1.

FIG. 4 shows a sectional view of the retaining mechanism 16 from FIG. 1 along line IV—IV. The retaining mechanisms 16 have a locking device 18 with a latch hook 19, 20 each at the feed pump 1 and the valve 2.

Figure 5:
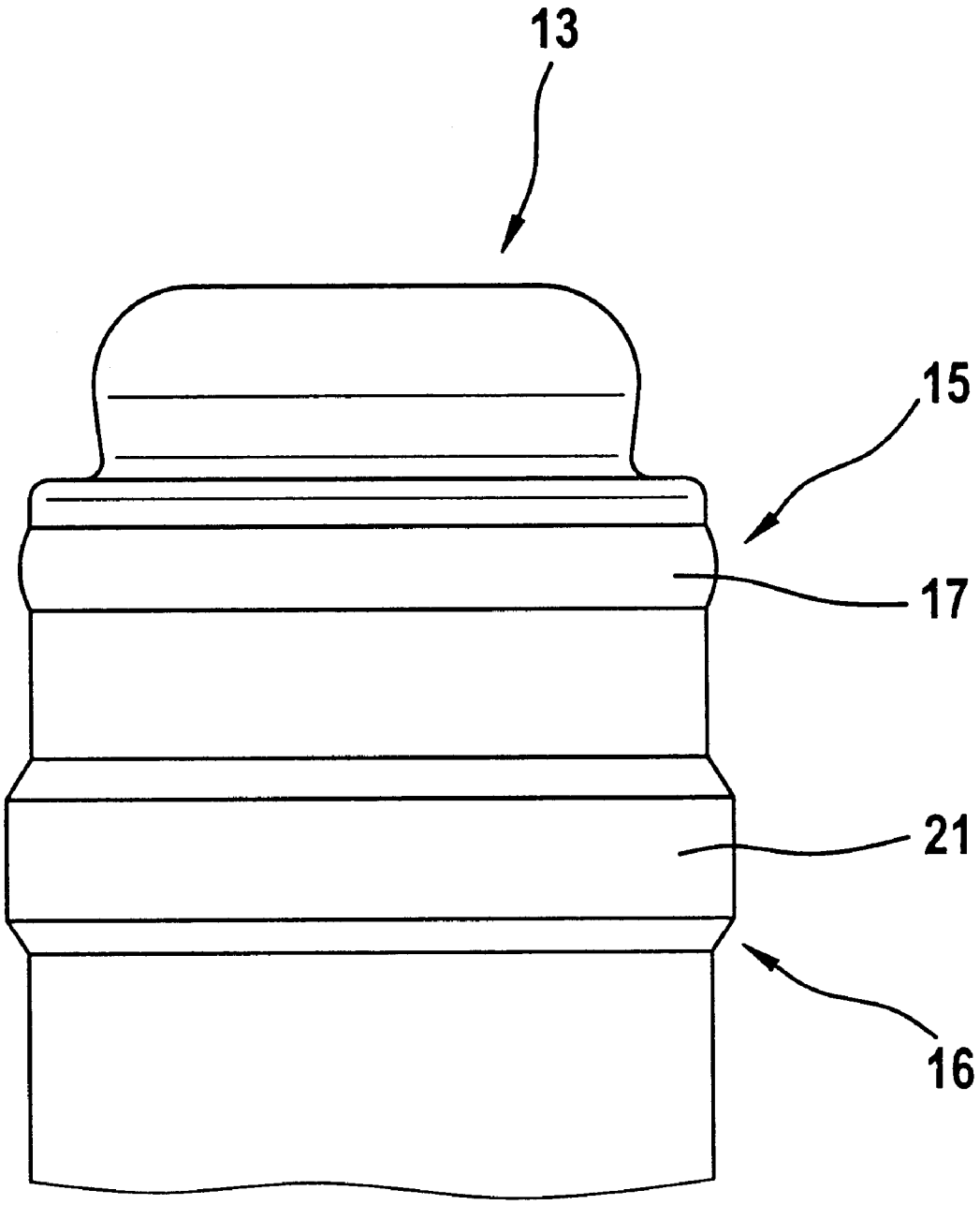
FIG. 5 is an enlarged view of an alternate design of the delivery device as described in the invention.

In the design shown in FIG. 5 the sealing devices 15 at the pump as well as the retaining mechanisms 16 are located on the nozzles 13. The beads 17, 21 are designed according to their function. The convex bead 17 serves as sealing device while the flat bead 21 provides the fixed fitting by operating together with a corresponding counterpart of the valve.

What is claimed is:

1. Delivery device for the delivery of fluids into two mutually independent nozzles using a feed pump, with a valve connecting the feed pump optionally with a first or a second nozzle, and with sealing devices and retaining mechanisms for the sealed connection of the valve to the feed pump, characterized by the sealing devices and the retaining mechanism being located apart from each other.

2. Delivery device according to claim 1 characterized by the retaining mechanism having a locking device.

3. Delivery device according to claim 1 or 2 characterized by the retaining mechanism being designed to provide pre-tension for the sealing devices.

4. Delivery device according to claim 1 characterized by the retaining mechanisms being located between the independent nozzles of the feed pump and the valve.

5. Delivery device according to at least one of the aforementioned claims, characterized by the nozzles of the feed pump and the valve being conically interlocking.

6. Delivery device according to claim 1, characterized by at least one of the nozzles having circumferentially extending sealing beads.

7. Delivery device according to at least one of the aforementioned claims, characterized by the locking device having matching latch hooks.

8. Delivery device according to claim 2, characterized by the locking device extending nearly across the entire area between the nozzles.

* * * * *